United States Patent [19]

Calligarich

[11] Patent Number: 4,667,552

[45] Date of Patent: May 26, 1987

[54] MICROPERFORATOR

[75] Inventor: Elio Calligarich, Cologno Monzese, Italy

[73] Assignee: FMC Corporation, Chicago, Ill.

[21] Appl. No.: 866,005

[22] Filed: May 22, 1986

[51] Int. Cl.[4] ..... B26F 1/24

[52] U.S. Cl. ..... 83/171; 83/660; 83/16

[58] Field of Search ..... 83/171, 16, 660

[56] References Cited

U.S. PATENT DOCUMENTS

| | | | |
|---|---|---|---|
| 2,748,863 | 6/1956 | Benton | 83/171 |
| 3,227,854 | 1/1966 | Ramsey et al. | 83/171 X |
| 3,546,742 | 12/1970 | Kugler | 83/171 X |
| 3,707,102 | 12/1972 | Huppenthal et al. | 83/171 |
| 3,718,059 | 2/1973 | Clayton | 83/171 X |
| 4,098,159 | 7/1978 | Rothfuss | 83/171 |

*Primary Examiner*—Donald R. Schran

*Attorney, Agent, or Firm*—Louis J. Pizzanelli; Richard B. Megley

[57] ABSTRACT

A sheet film perforator utilizes a plurality of heated pins projecting from a rotating cylinder to perforate film being drawn across the rotating cylinder. The pins are heated by multiple heat sources including a central heating element for heating the rotating cylinder from the inside and surface heaters mounted adjacent the pins to heat the pins from the outside and maintain a controlled pin temperature during the perforation operation. A heat shield is provided to syncronously be positioned when a pressure roll brush retractor removes film from engagement with the hot pin perforation roller. Perforation dimensions may be controlled through the use of micro adjusting means for controlling hot pin penetration into the film.

12 Claims, 6 Drawing Figures

FIG_1
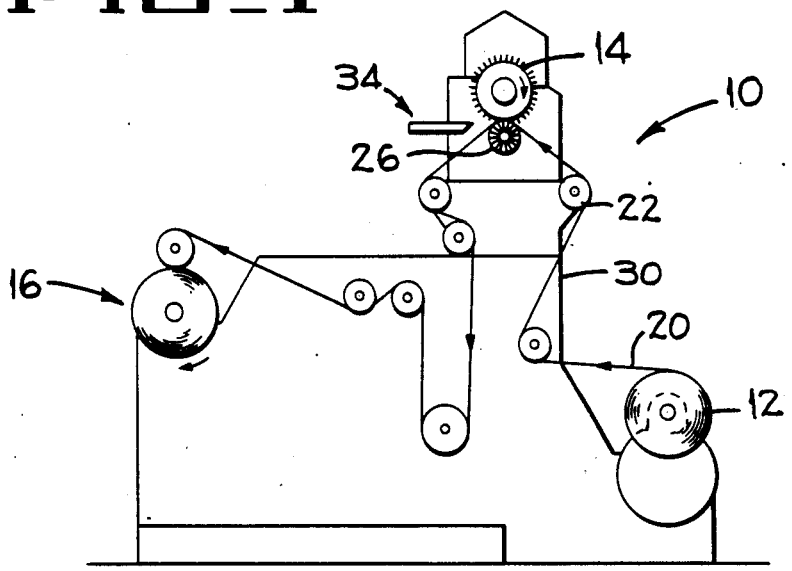
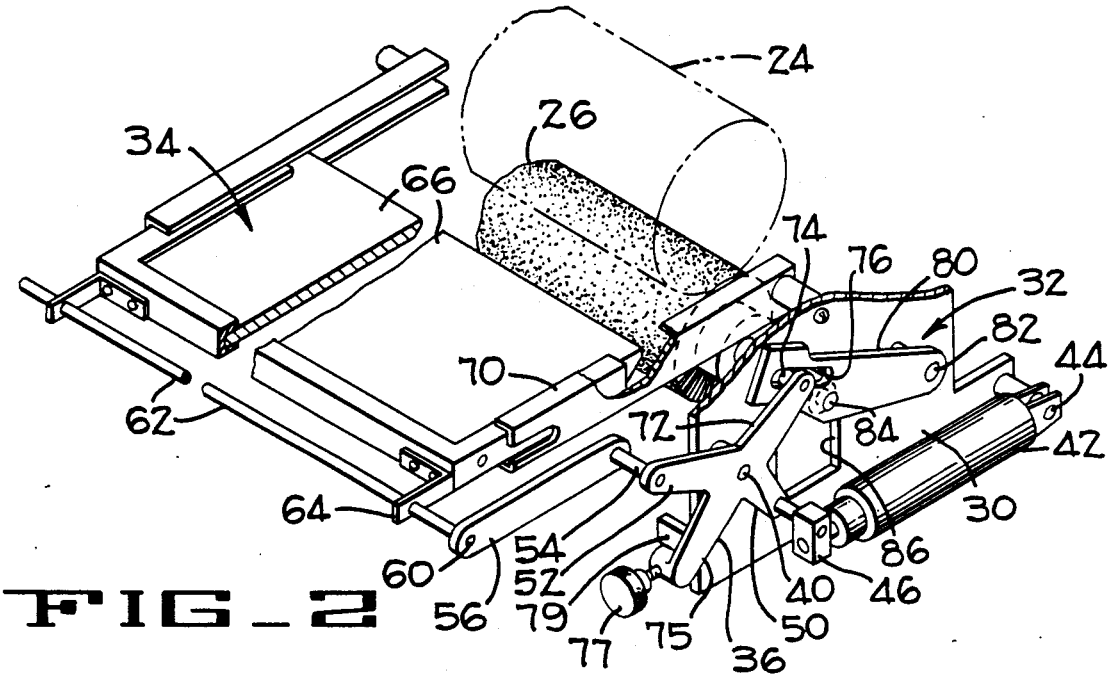
FIG_2
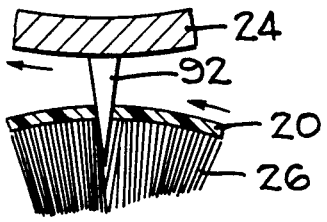
FIG_5
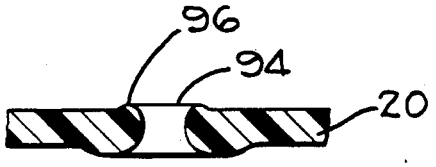
FIG_6

MICROPERFORATOR

BACKGROUND OF THE INVENTION

1. Field of the Invention

The invention has to do with the perforation of film material generally, but not exclusively, of thermo plastic material. Heated perforation pins are carried by a rotating cylinder and the film to be perforated is forced against the pins by a pressure means such as a deformable roller. The heated pins cause perforations in the film and partially melt the film so that uniform tear resistant perforations are formed.

2. Discription of the Prior Art

Heated pin perforators have been provided wherein the pins are heated from a heat source inside the pin hosting rotating cylinder and wherein the pins are heated from a heat source on the exterior of the pin hosting rotating cylinder as well as a combination of both.

Perforation of thermo plastic film materials is very desirable for many applications where a wrapping having permeability is desirable. Typical applications include the wrapping of food articles such as vegetables where conventional wrapping products prevent the free flow of air to the product thereby causing the product to spoil. Perforated films also find applications as filtering medium.

However, none of the prior art heated pin perforation machines have the advantage of having an internally heated pin hosting rotating cylinder with a first external heat source adjacent to and longitudially disposed along the length of the cylinder but also providing a second focused heat source adjacent to and longitudially disposed along the length of the cylinder.

Furthermore, no prior art devices are known to the applicant hereof wherein the external heat source adjacent to the cylinder is pivotally mounted for movement from a position proximate the cylinder to a position providing access to the cylinder.

DRAWING FIGURES

In the drawings there are several figures which show various aspects of the perforation machine. A perusal of these drawing figures in combination with the following text will enable the reader to have a clear understanding of the invention disclosed herein. The drawing figures are:

FIG. 1 is a schematic presentation of an end view of a hot pin perforator showing the path followed by material being processed and complete with a material letoff and a rewinder section mounted with the perforation head.

FIG. 2 is a partially sectioned perspective view of a portion of a perforation head showing the pressure roller means and the heat shield means of the perforator.

FIG. 5 is a partially sectioned view of a pin penetrating fabric as the fabric moves across a pressure roller.

FIG. 6 is a sectioned view showing film deformation around a pierced aperture.

DETAILED DISCRIPTION OF THE INVENTION

Figure 4:
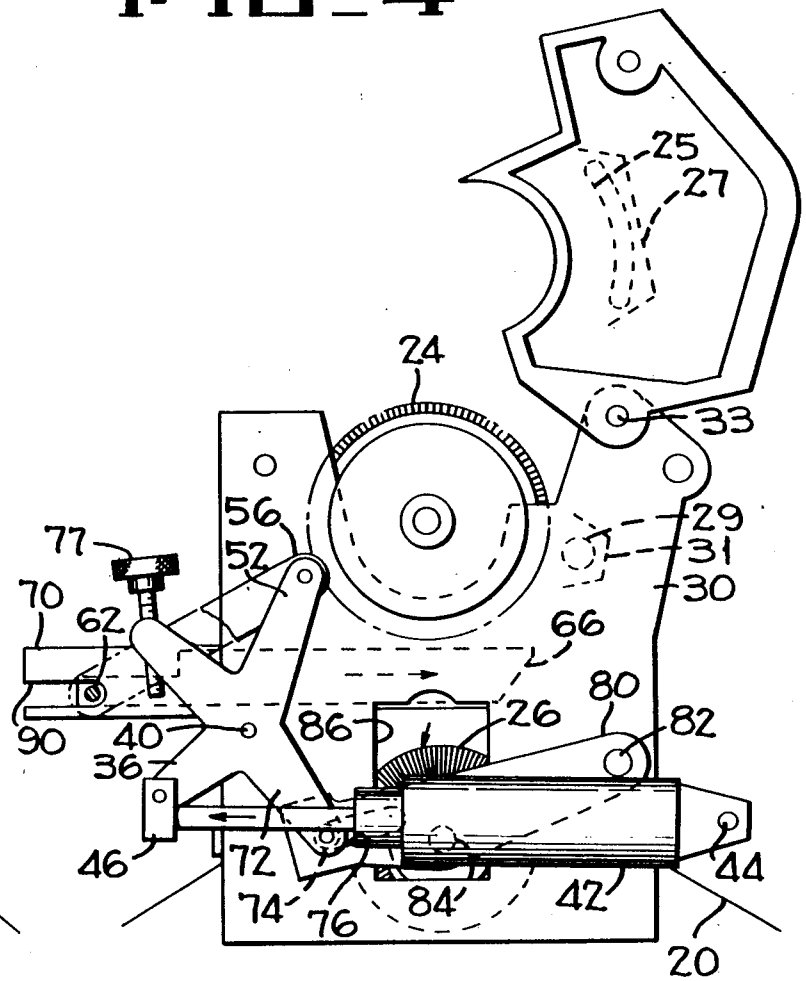
FIG. 4 is an end view of the head unit showing the heat shield and pressure roller positioning means in a running mode.

Although the perforation head of this apparatus is the subject of this application, it is most understandable if the perforation head is shown in a normal environment, that is with the letoff mechanism and a windup mechanism. The schematic FIG. 1 presents a hot pin perforator generally 10 having a fabric letoff station 12, a perforator head unit 14 and a windup section generally 16. Fabric 20 is threaded through several tensioning and alignment rolls such as 22 in a conventional manner.

The hot pin perforator roll 24 is located in proximity to a pressure roll, or pressure control roll 26 and the letoff 12, windup 16 and perforator head unit 14 can all be supported on a frame means such as 30.

The detail of the perforator head unit shown in FIG. 1 is shown in FIG. 2 in considerably more detail. Looking at FIG. 2 the hot pin perforator roll 24 is shown as a phantom representation so that the pressure control roll 26 can be more easily seen. The perforator head unit is shown with a break intermediate the ends thereof to foreshorten this view.

In this view the frame means 30, at both ends thereof, even though only a single end is shown for clarity, supports a pressure roll engagement means generally 32 and a heat shield means generally 34 which are both actuated through a bell crank means 36 pivotally mounted to the frame means 30 at pivot point 40. Actuation for the bell crank 36 is provided through the air cylinder 42 which is pivotally mounted at a fixed end 44 thereof. The cylinder or ram 42 is connected at its rod end 46 to the first leg 50 of the bell crank means 36. The ram 42 may be a hydraulic ram if desired, however, a preferred embodiment incorporates the air actuated ram as shown.

A second leg 52 of the bell crank 36 is connected through a pivotable pin connection 54 to a tie rod 56 having a transverse rod receiving end 60. A transverse rod 62 extends the width of the hot pin perforator head 14 and is connected at several points along its length by attachment means such as 64. The attachment means 64 connects the transverse rod 62 to a heat shield 66 which, in a preferred embodiment, is a thermal barrier comprising a reflective surface over an insulating material. The heat shield 66 is slidingly carried in rails 70 that allow the heat shield to slide into a position between the hot pin perforator roll 24 and the pressure control roll 26. The heat shield 66 would normally be in the retracted position as shown when the hot pin perforator is processing film.

A third leg 72 of the bell crank 36 has a roller bearing 74 supported on the end of the third leg 72 extending inboard toward the pressure control roll 26. The bearing surface or means 74 extends into a slot 76 in a pressure control roll support link 80. The pressure roll support link 80 is pivotally mounted at pivot point 82. The pressure control roll 26 is carried, through supports at each end thereof, to the pressure roll support link 80 at mounting location 84. Notice that the pressure control roll has axles at each end thereof that extend through the access aperture 86 in the frame means 30.

A fourth leg 75 is part of the bell crank means 36 and provides a location for a micro adjuster means 77 that is used to adjust the position of the pressure control roll 26. With the pressure control roll grossly positioned to serve the film 20 to the hot pin perforator roll 24, the pressure control roll will be finely adjusted through the micro adjusters 77 to effectuate the desired perforation dimension. The micro adjuster 77 abuts plate 79 on the frame 30.

It should be noted that the various bell crank means 36, ram 42, pressure roll support link 80 and attachments thereto are duplicated, in a mirror image as neccessary, on the other side of the hot pin perforator head 14.

One aspect of this invention is facilitating the heat shield placement when the hot pin perforator is stopped with film on the perforator roll.

Figure 3:
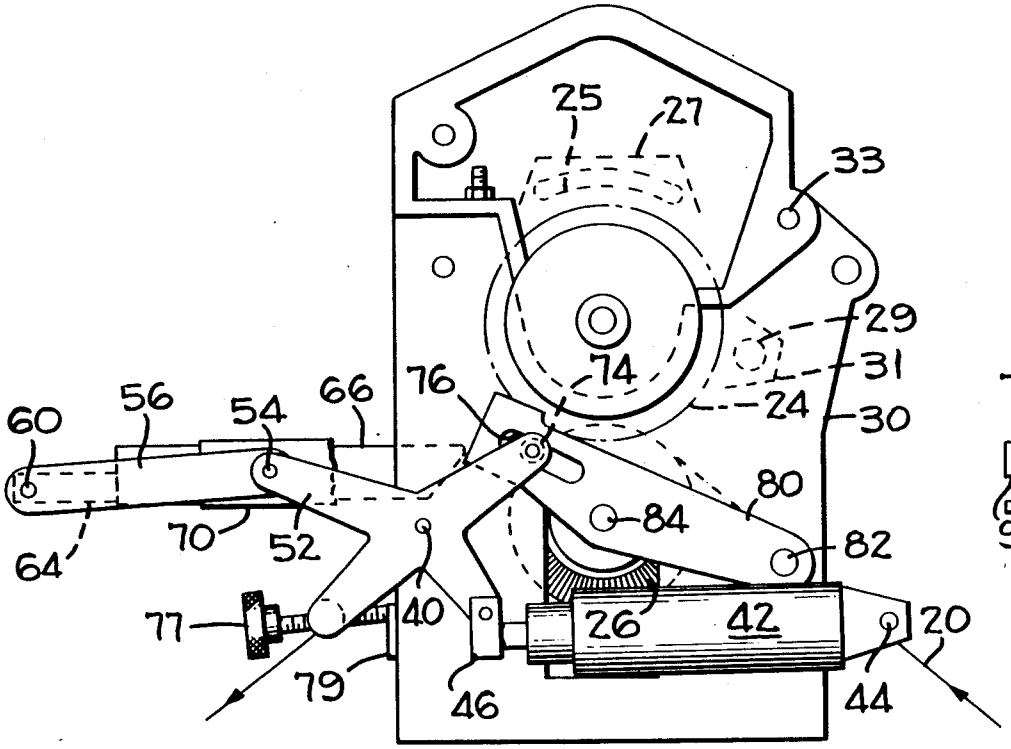
FIG. 3 is an end view of the head unit showing the heat shield and pressure roller positioning means.

It would be detrimental to the film being processed, which in an expected embodiment would be a synthetic thermoplastic film material, if it were left in contact with the hot pins of the hot pin perforator roll 24. The polyethelene or polyprypalene film, for example, would melt or at least significantly deform. In order to prevent such deliterous action the pressure control roll 26 can be moved away from the hot pin perforator roll 24 allowing the film to be pulled away from the hot pin perforator roll while simultaneously inserting a heat shield between the hot pin perforator roll and the pressure control roll. FIGS. 3 and 4 best show how this is accomplished.

In FIG. 3, showing only one end of the perforator head unit 14, the unperforated film 20 is fed into the bite between the pressure control roll 26 and the hot pin perforator roll 24. The ram or cylinder 42, which could be air or hydraulically actuated, is in a retracted position such that the bell crank means 36 is in the position shown in FIG. 3 with the pressure roll support link 80 in an upwardly disposed position such that the pressure control roll 26 forces the film 20 into contact with the hot pins. The pressure control roll 26 is a counter pressure means for holding the film or fabric 20 into contact with the hot pin as well as gauging how deeply the pins will pierce the film. Gauging is accomplished through adjustment of the micro adjusters such as 77 acting on the plate 79. In this position the heat shield 34 is in a retracted position as shown.

This position is the running position with the film or fabric contacting the hot pin perforator for only a brief moment as the film is fed through the hot pin perforator. As stated earlier, if the machine is to stop then the film should be removed from contact with the hot pin perforator roll.

In FIG. 4 the hot pin perforator has been stopped and the film taken out of contact with the hot pins. This is accomplished by extending the ram 42 such that the bell crank means 36 is rotated about pivot point 40 causing the second leg 52 of the bell crank to bring the tie rod 56 relatively inboard. As the tie rod 56 is connected to the transverse rod 62 and ultimately to the heat shield 66, the heat shield will be urged inwardly in the rails 70 such that it will be interposed between the hot pin perforator roll 24 and the pressure control roll 26 thereby shielding the film, which is on the surface of the pressure control roll from the heat eminating from the hot pin perforator roll 24.

The control slot 90 is positioned in the rails 70 so that the transverse rod 62 can enter the control slot 90 to assist in preventing binding of the heat shield 66 as it travels inboard on the rails 70.

The third leg 72 of the bell crank means 36 is pivotally attached through a bearing to the pressure roll support link 80 which is in turn is pivotally mounted at pivot point 82 to the frame means 30. The mounting location 84 of the axle of the pressure control roll 26 is on the pressure roll support link 80 thus when the bell crank means 36 is rotated by actuation of the air cylinder 42 the pressure control roll 26 will be lowered away from the hot pin perforator roll 24 to make room for the heat shield 66.

Upon startup the heat shield 66 will be partially removed before the pressure control roll 26 starts upward toward the hot pin perforator roll 24. Upon actuation of the air cylinder 42, that is, retraction thereof, the bell crank means will be rotated counter clockwise around the pivot point 40. The slot 76 will allow the connected leg 72 of the bell crank means to travel the length of the slot 76 before the pressure control roll 26 starts an appreciable amount toward the hot pin perforator roll 24. Once the bell crank arm 72 reaches the end of the slot 76 the pressure control roll 26 will rise rapidly toward the perforator roll. There may be times when the pressure control roll 26 need not be located as close to the perforator roll as the slot 76 will allow. In those situations the micro adjusters 77 (or micro adjecting means) will be screwed into their mountings so that they contact the plates or stop means 79 which would be integral with or actually part of the frame means 30. This will prevent the pressure control roll from moving to the extreme of its travel.

FIGS. 3 and 4 also shows the end views of the perforator roll heating devices in hidden lines. The hot pin perforator roll is internally heated using an electrical element (not shown) that provides the base line heat source for the perforator roll 24. The hot pins on the exterior surface of the perforator roll will, however, lose heat at a rapid rate when the perforator is being operated. In order to maintain the hot pins at an optimum temperature, two additional heat sources are used. A first infrared heat source 25 is positioned between a heat shield 27 and the perforator roll 24 generally for the length of the perforator roll. This heat source is a curved panel that emits a broadly focused pattern of heat energy to heat the hot pins as they pass below it. This type of hot pin heater is known and is available from several electrical equipent manufactures.

A second source of heat energy is provided by the bar shaped infrared heater 29 which provides a very focused source of heat energy to the hot pins just before they are rotated into contact with the film 20. The shield 31 serves to further focus the heat energy and direct it at the hot pins. It has been found that a broad source of infrared energy at this low mounting location would impinge on the film being fed heating it somewhat and adversly affect its perforability.

In FIG. 4 it can be seen that the top portion of the perforator head is hinged at 33 so that it can be swung open to the position shown in FIG. 4 to facilitate removal of the hot pin perforator roll 24 effectuating quick roll charges of hot pin perforator rolls having alternative pin arrangements.

FIGS. 5 and 6 relate to the method of perforating the film and the specific result possible through the use of the hot pin perforator. In FIG. 5 the very simplified and partially sectioned perforator roll is 24 with a representative hot pin 92 is shown projecting through a sheet of film 20. The hot pin pierces the film and extends into the pressure control roll 26, the surface of which is made up of upstanding bristles presenting a dense brush-like surface that will support the film 20 while allowing the hot pin to perforate the film and extend into the pressure control roll. The space between the pressure control roll 26 and the hot pin perforator roll 24 can be adjusted through actuation of the air cylinder 42. The slot 76 in the pressure roll support link 80 allows the third leg 72 of the bell crank to be moved clockwise around its pivot point 40 thereby letting the mounting location for the pressure roller 84 drop down as well. With just slight movement of the air cylinder or ram 42 the pressure roll will move a small amount to affect the position of the film and the hot pins, that is, the depth of penetration of the pins through the film is thereby adjusted. A more controlled adjustment is provided by the micro adjusters 77 as previously described. Since the hot pins 92 are tapered, larger perforations will be made as the fabric moves up the hot pin's length. An alternative embodiment would have hot pins with piercing ends but straight sides beyond or inboard of the piercing end. This could allow the hot pin to contact the hole edges for a longer dwell and thus affect the characteristics of the perforation.

FIG. 6 shows, in cross section, the typical perforation 94 expected in a sheet of plastic film 20. The hot pin has entered from the top of this fabric sample and as the hot pin melted the surrounding film, after the pin perforated the film, the plastic fabric or material is melted into the upset structure shown by the protuberance 96. The film, after perforation, will have one smooth face and an obverse face that has a texture due to the proliferation of protuberances. Hot pin spacing will determine the actual feel of the film and perferred embodiments of the pin spacing show pins on sixtenth inch centers.

Thus it can be seen that a hot pin perforator has been provided that incorporates a novel heat shield deployment and pressure roll positioning device that is an improvment over previously known hot pin perforators. A novel heat source arrangement and pivoting head portion has also been provided. Several nuances of design obvious to a person of ordinary skill in the art are possible and have been contemplated by the inventor and such nuances of design can be incorporated without departing from the spirit and scope of the attached claims and such design nuances are not to be construed as being outside the appended claims.

What is claimed is:

1. Apparatus for providing perforations in a film comprising:

a hot pin perforator roll mounted for rotation in a frame means;

a counter pressure roll mounted for rotation on support means carried by said frame means;

a central heating element carried inside said hot pin perforator roll cylinder;

first surface heater mounted adjacent said hot pins of said hot pin perforator roll;

second surface heater projecting a narrow zone of heat to said hot pins mounted adjacent said hot pins of said hot pin perforator roll.

2. The invention in accordance with claim 1 wherein said first surface heater is an infrared heating element which projects a wide beam of unfocused heat energy to said hot pin perfortor roll.

3. The invention in accordance with claim 2 wherein said second surface heater is an infrared heating element which projects a narrow, focused beam of heat energy to said hot pin perforator roll.

4. The invention in accordance with claim 3 wherein a heat shield is provided to substantially enclose said second surface heater while allowing said focused beam of heat energy to be directed to said hot pin perforator roll.

5. The invention in accordance with claim 4 wherein said frame means supports a hot pin perforator roll head, said hot pin perforator roll head having an upper housing pivotally mounted to a lower housing whereby said upper housing can be pivotally displaced to expose said hot pin perforator roll.

6. The invention in accordance with claim 5 wherein said hot pin perforator roll is supported in a bearing surface in said lower housing of said hot pin perforator roll head and is restrained in place by a second bearing surface in said upper housing of said hot pin perforator roll head.

7. The invention in accordance with claim 6 wherein said upper housing of said hot pin perforator roll head houses said first surface heater.

8. The invention in accordance with claim 3 wherein said frame means supports heat shield means comprising:

a heat shield mounted on track means slidably positionable between said hot pin perforator roll and said counter pressure roll;

linkage means to slidably position said heat shield on said track means.

9. The invention in accordance with claim 8 wherein said linkage means comprises:

actuator means carried on said frame means;

bell crank means pivotally carried on said frame means having a first crank arm connected to said actuator means;

second crank arm means integral with said bell crank means having an output connected through a tie rod to said heat shield whereby actuation of said actuator means will cause said heat shield to move into a shielding position between said hot pin perforator roll and said pressure control roll.

10. The invention in accordance with claim 9 wherein said bell crank means has a third leg pivotally connected to a pressure roll support link;

said pressure roll support link pivotally mounted on said frame means and further having mounting means to support said pressure control roll.

11. The invention in accordance with claim 10 wherein said pressure control roll will be moved away from a proximate relationship with said hot pin perforator roll when said actuator means rotates said bell crank means clockwise while simultaneously positioning said heat shield between said hot pin perforator roll and said pressure control roll.

12. The invention in accordance with claim 11 wherein said bell crank means has a fourth leg supporting a micro adjusting means, said micro adjusting means capable of contacting stop means whereby the proximity of said pressure control roll to said hot pin perforator roll can be controlled.

* * * * *